US010107559B2

(12) United States Patent
Lan

(10) Patent No.: US 10,107,559 B2
(45) Date of Patent: Oct. 23, 2018

(54) HEAT DISSIPATION COMPONENT

(71) Applicant: ASIA VITAL COMPONENTS CO., LTD., New Taipei (TW)

(72) Inventor: Wen-Ji Lan, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 31 days.

(21) Appl. No.: 15/166,281

(22) Filed: May 27, 2016

(65) Prior Publication Data

US 2017/0343298 A1 Nov. 30, 2017

(51) Int. Cl.
*F28D 15/04* (2006.01)

(52) U.S. Cl.
CPC ..... *F28D 15/04* (2013.01)

(58) Field of Classification Search
CPC .. F28D 15/04; F28D 15/0266; F28D 15/0233; F28D 2021/0028; F28D 15/046; F28D 15/0275; F28F 9/013
USPC ..... 165/104.26, 104.22, 104.13
See application file for complete search history.

(56) References Cited

U.S. PATENT DOCUMENTS 5,275,232 A 1/1994 Adkins et al.
5,899,265 A * 5/1999 Schneider ..... F28D 15/0275 165/104.13
6,390,185 B1 5/2002 Proeschel
8,176,973 B2 * 5/2012 Liao ..... F28D 15/046 165/104.26
2006/0201656 A1 * 9/2006 Lai ..... F28D 15/0233 165/104.26
2006/0283577 A1 * 12/2006 Liu ..... F28D 15/043 165/104.26
2007/0199682 A1 * 8/2007 Hwang ..... F28D 15/046 165/104.26
2008/0121387 A1 * 5/2008 Taniguchi ..... F28D 1/05333 165/175
2009/0242174 A1 * 10/2009 McCutchen ..... F28D 15/0233 165/104.25
2014/0138058 A1 * 5/2014 Hyde ..... F28D 15/04 165/104.26
2014/0144169 A1 * 5/2014 Inaba ..... G06F 1/20 62/259.2
2014/0182819 A1 * 7/2014 Yang ..... F28D 15/02 165/104.26
2016/0128234 A1 * 5/2016 Uesugi ..... H05K 7/20336 361/700

FOREIGN PATENT DOCUMENTS

TW M517314 U 2/2016

* cited by examiner

*Primary Examiner* — Raheena R Malik
(74) *Attorney, Agent, or Firm* — C. G. Mersereau; Nikolai & Mersereau, P.A.

(57) ABSTRACT

A heat dissipation component includes: a first main body having a first chamber; a second main body having a second chamber; a third main body having a third chamber; a first tubular body having a first flow way, two ends of the first tubular body being respectively connected with the first and second main bodies; and a second tubular body having a second flow way. The second tubular body is passed through the second main body and the first flow way. Two ends of the second tubular body are respectively connected with the first and third main bodies. A working fluid is filled in the first, second and third chambers.

13 Claims, 9 Drawing Sheets

HEAT DISSIPATION COMPONENT

BACKGROUND OF THE INVENTION

1. Field of the Invention

The present invention relates generally to a heat dissipation component, and more particularly to a heat dissipation component having multiple heat dissipation effects and is able to greatly enhance the heat exchange efficiency.

2. Description of the Related Art

Along with the advance of semiconductor technique, the volume of integrated circuit has become smaller and smaller. In order to process more data, the current integrated circuit with the same volume has contained numerous calculation components several times more than the components contained in the conventional integrated circuit. There are more and more calculation components contained in the integrated circuit. Therefore, the execution efficiency of the integrated circuit is higher and higher. As a result, in working, the heat generated by the calculation components is also higher and higher. With a common central processing unit taken as an example, in a full-load working state, the heat generated by the central processing unit is high enough to burn down the entire central processing unit. Therefore, the heat dissipation problem of the integrated circuit has become a very important issue.

The central processing unit and the chips or other electronic components in the electronic apparatus are all heat sources. When the electronic apparatus operates, these heat sources will generate heat. Currently, heat conduction components with good heat dissipation and conduction performance, such as heat pipes, vapor chambers and flat-plate heat pipes are often used to conduct or spread the heat. In these heat dissipation components, the heat pipe serves to conduct heat to a remote end. One end of the heat pipe absorbs the heat to evaporate and convert the internal liquid working fluid into vapor working fluid. The vapor working fluid transfers the heat to the other end of the heat pipe to achieve the heat conduction effect. With respect to a part with larger heat transfer area, a vapor chamber is selected as the heat dissipation component. One plane face of the vapor chamber is in contact with the heat source to absorb the heat. The heat is then transferred to the other face and dissipated to condense the vapor working fluid.

However, both the conventional heat pipe and vapor chamber are heat dissipation components for solving one single problem. In other words, the heat pipe or vapor chamber disposed in the electronic apparatus can only dissipate the heat of the heat source by means of conducting the heat to the remote end or spreading the heat, while failing to achieve both the heat spreading and remote-end heat conduction effects. As a result, the heat exchange efficiency is relatively poor.

SUMMARY OF THE INVENTION

It is therefore a primary object of the present invention to provide a heat dissipation component having multiple heat dissipation effects.

It is a further object of the present invention to provide a heat dissipation component, which can greatly enhance the heat exchange efficiency.

To achieve the above and other objects, the heat dissipation component of the present invention includes a first main body, a second main body, a first tubular body, a third main body, a second tubular body and a working fluid. The first main body has a first plate body and a second plate body. The first and second plate bodies are correspondingly mated with each other to together define a first chamber. A first capillary structure is disposed in the first chamber. The second plate body is formed with a first connection section. The second main body has a third plate body and a fourth plate body. The third and fourth plate bodies are correspondingly mated with each other to together define a second chamber. A second capillary structure is disposed in the second chamber. The third plate body is formed with a second connection section. The first tubular body has a first end, a second end and a first flow way. A fourth capillary structure is disposed on inner wall face of the first tubular body. The first end is correspondingly connected with the first connection section and abuts against inner side of the first plate body. The second end is correspondingly connected with the second connection section and abuts against inner side of the fourth plate body. The fourth capillary structure is in capillary contact with the first and second capillary structures. The first end of the first tubular body is formed with at least one first perforation in communication with the first chamber. The second end of the first tubular body is formed with at least one second perforation in communication with the second chamber, whereby the first flow way communicates with the first and second chambers through the first and second perforations. The fourth plate body is further formed with a third connection section in alignment with the second connection section. The third main body has a fifth plate body and a sixth plate body. The fifth and sixth plate bodies are correspondingly mated with each other to together define a third chamber. A third capillary structure is disposed in the third chamber. The fifth plate body is formed with a fourth connection section. The second tubular body has a third end, a fourth end and a second flow way. A fifth capillary structure is disposed on inner wall face of the second tubular body. The third end is passed through the first, second and third connection sections and the first flow way and abuts against the inner side of the first plate body. The fourth end is correspondingly connected with the fourth connection section and abuts against inner side of the sixth plate body. The fifth capillary structure is in capillary contact with the first and third capillary structures. The third end of the second tubular body is formed with at least one third perforation in communication with the first chamber. The fourth end of the second tubular body is formed with at least one fourth perforation in communication with the third chamber, whereby the second flow way communicates with the first and third chambers through the third and fourth perforations. The second tubular body has a diameter smaller than a diameter of the first tubular body.

According to the above structural design of the present invention, when the first main body of the heat dissipation component contacts the heat source, the liquid working fluid in the first chamber will absorb the heat and become vapor working fluid. Then, the vapor working fluid will partially flow through the first perforation and the first flow way into the second chamber. The vapor working fluid will condense and convert into liquid working fluid in the second chamber. Then, the liquid working fluid will flow back into the first chamber through the second and fourth capillary structures to continuously circulate. The other part of the vapor working fluid will flow through the first perforation of the first tubular body and the second flow way into the third chamber. The vapor working fluid will condense and convert into liquid working fluid in the third chamber. Then, the liquid working fluid will flow back into the first chamber through the third and fifth capillary structures to continuously circulate. The heat sinks disposed between the first and second main bodies and the second and third main bodies cooperatively dissipate the heat to complete the vapor-liquid circulation in the heat dissipation component. Therefore, the heat dissipation component can achieve multiple heat dissipation effects to greatly enhance the heat exchange efficiency.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
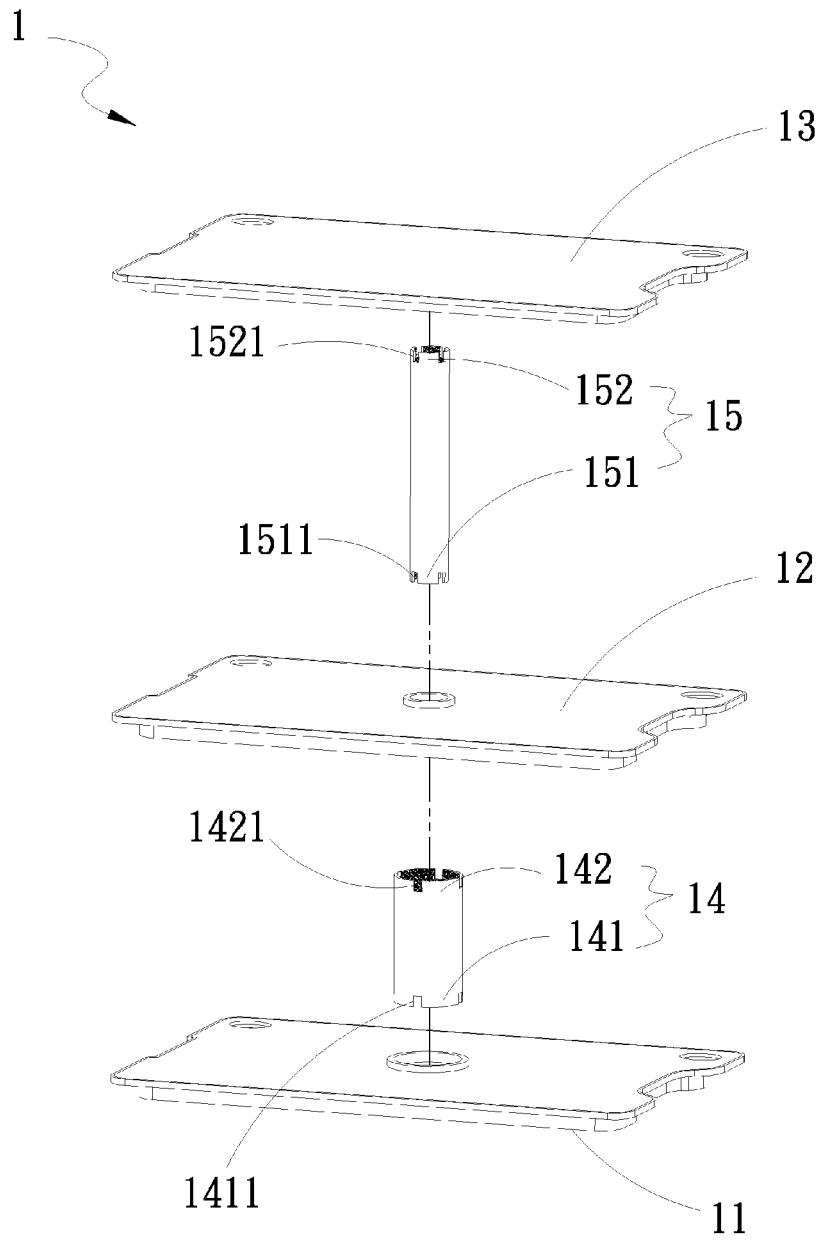
FIG. 1 is a perspective exploded view of a first embodiment of the heat dissipation component of the present invention.
Figure 2:
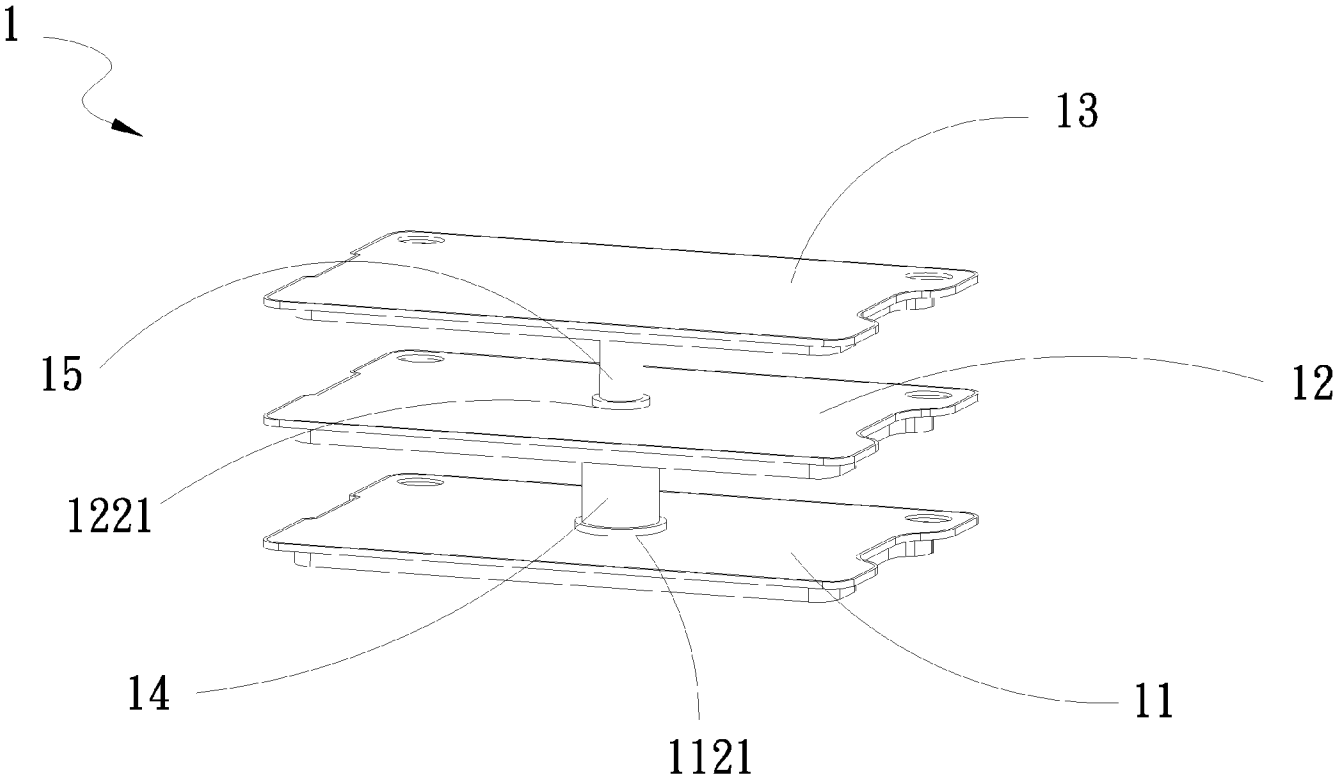
FIG. 2 is a perspective assembled view of the first embodiment of the heat dissipation component of the present invention.
Figure 3:
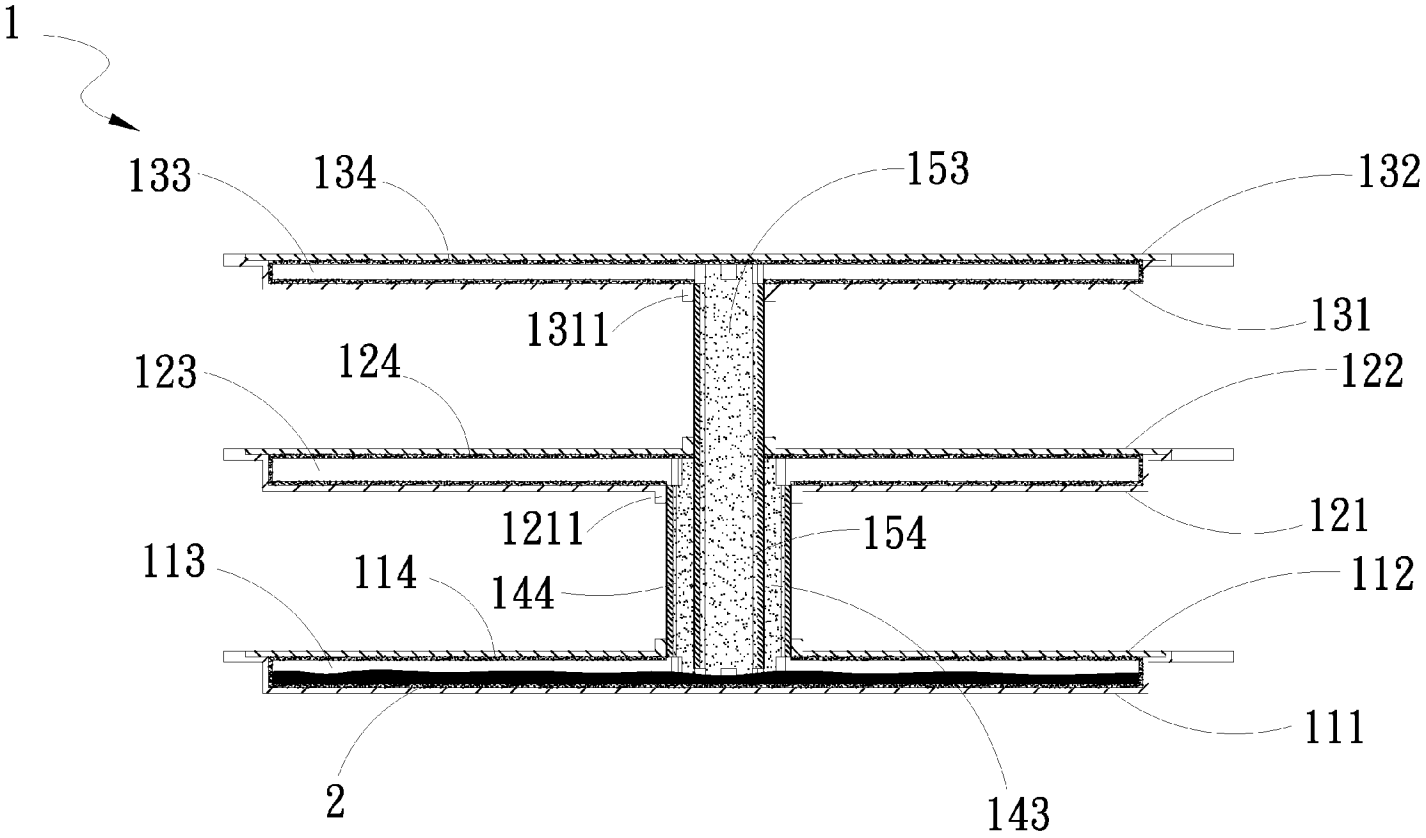
FIG. 3 is a sectional view of the first embodiment of the heat dissipation component of the present invention.

Please refer to FIGS. 1, 2 and 3. FIG. 1 is a perspective exploded view of a first embodiment of the heat dissipation component of the present invention. FIG. 2 is a perspective assembled view of the first embodiment of the heat dissipation component of the present invention. FIG. 3 is a sectional view of the first embodiment of the heat dissipation component of the present invention. According to the first embodiment, the heat dissipation component 1 of the present invention includes a first main body 11, a second main body 12, a first tubular body 14, a third main body 13, a second tubular body 15 and a working fluid 2. The first main body 11 has a first plate body 111 and a second plate body 112. The first and second plate bodies 111, 112 are correspondingly mated with each other to together define a first chamber 113. A first capillary structure 114 is disposed in the first chamber 113. The second plate body 112 is formed with a first connection section 1121. The second main body 12 has a third plate body 121 and a fourth plate body 122. The third and fourth plate bodies 121, 122 are correspondingly mated with each other to together define a second chamber 123. A second capillary structure 124 is disposed in the second chamber 123. The third plate body 121 is formed with a second connection section 1211. The first tubular body 14 has a first end 141, a second end 142 and a first flow way 143. A fourth capillary structure 144 is disposed on inner wall face of the first tubular body 14. The first end 141 is correspondingly connected with the first connection section 1121 and abuts against inner side of the first plate body 111. The second end 142 is correspondingly connected with the second connection section 1211 and abuts against inner side of the fourth plate body 122. The fourth capillary structure 144 is in capillary contact with the first and second capillary structures 114, 124. The first end 141 of the first tubular body 14 is formed with at least one first perforation 1411 in communication with the first chamber 113. The second end 142 of the first tubular body 14 is formed with at least one second perforation 1421 in communication with the second chamber 123. Accordingly, the first flow way 143 communicates with the first and second chambers 113, 123 through the first and second perforations 1411, 1421.

The fourth plate body 122 is further formed with a third connection section 1221 in alignment with the second connection section 1211. The third main body 13 has a fifth plate body 131 and a sixth plate body 132. The fifth and sixth plate bodies 131, 132 are correspondingly mated with each other to together define a third chamber 133. A third capillary structure 134 is disposed in the third chamber 133. The fifth plate body 131 is formed with a fourth connection section 1311.

The second tubular body 15 has a third end 151, a fourth end 152 and a second flow way 153. A fifth capillary structure 154 is disposed on inner wall face of the second tubular body 15. The third end 151 is passed through the first, second and third connection sections 1121, 1211, 1221 and the first flow way 143 and abuts against the inner side of the first plate body 111. The fourth end 152 is correspondingly connected with the fourth connection section 1311 and abuts against the inner side of the sixth plate body 132. The fifth capillary structure 154 is in capillary contact with the first and third capillary structures 114, 134. The third end 151 of the second tubular body 15 is formed with at least one third perforation 1511 in communication with the first chamber 113. The fourth end 152 of the second tubular body 15 is formed with at least one fourth perforation 1521 in communication with the third chamber 133. Accordingly, the second flow way 153 communicates with the first and third chambers 113, 133 through the third and fourth perforations 1511, 1521.

The working fluid 2 is filled in the first, second and third chambers 113, 123, 133. The working fluid 2 is selected from a group consisting of pure water, inorganic compound, alcohol group, ketone group, liquid metal, coolant and organic compound.

The first, second, third, fourth and fifth capillary structures 114, 124, 134, 144, 154 are selected from a group consisting of mesh bodies, fiber bodies, sintered powder bodies, combinations of mesh bodies and sintered powders and microgroove bodies. The capillary structures are porous structures for providing capillary attraction to drive the working fluid 2 to flow.

The second tubular body 15 has a diameter smaller than that of the first tubular body 14. The diameter of the third and fourth connection sections 1221, 1311 is smaller than the diameter of the first and second connection sections 1121, 1211. In other words, the diameter of the first tubular body 14 is equal to the diameter of the first and second connection sections 1121, 1211, whereby the first tubular body 14 can be tightly connected with the first and second main bodies 11, 12. The diameter of the second tubular body 15 is equal to the diameter of the third and fourth connection sections 1221, 1311, whereby the second tubular body 15 can be tightly connected with the second and third main bodies 12, 13.

A hub section is formed on each of the first, second, third and fourth connection sections 1121, 1211, 1221, 1311, whereby the first and second main bodies 11, 12 can be more tightly connected with the first tubular body 14 and the second and third main bodies 12, 13 can be more tightly connected with the second tubular body 15.

Figure 4:
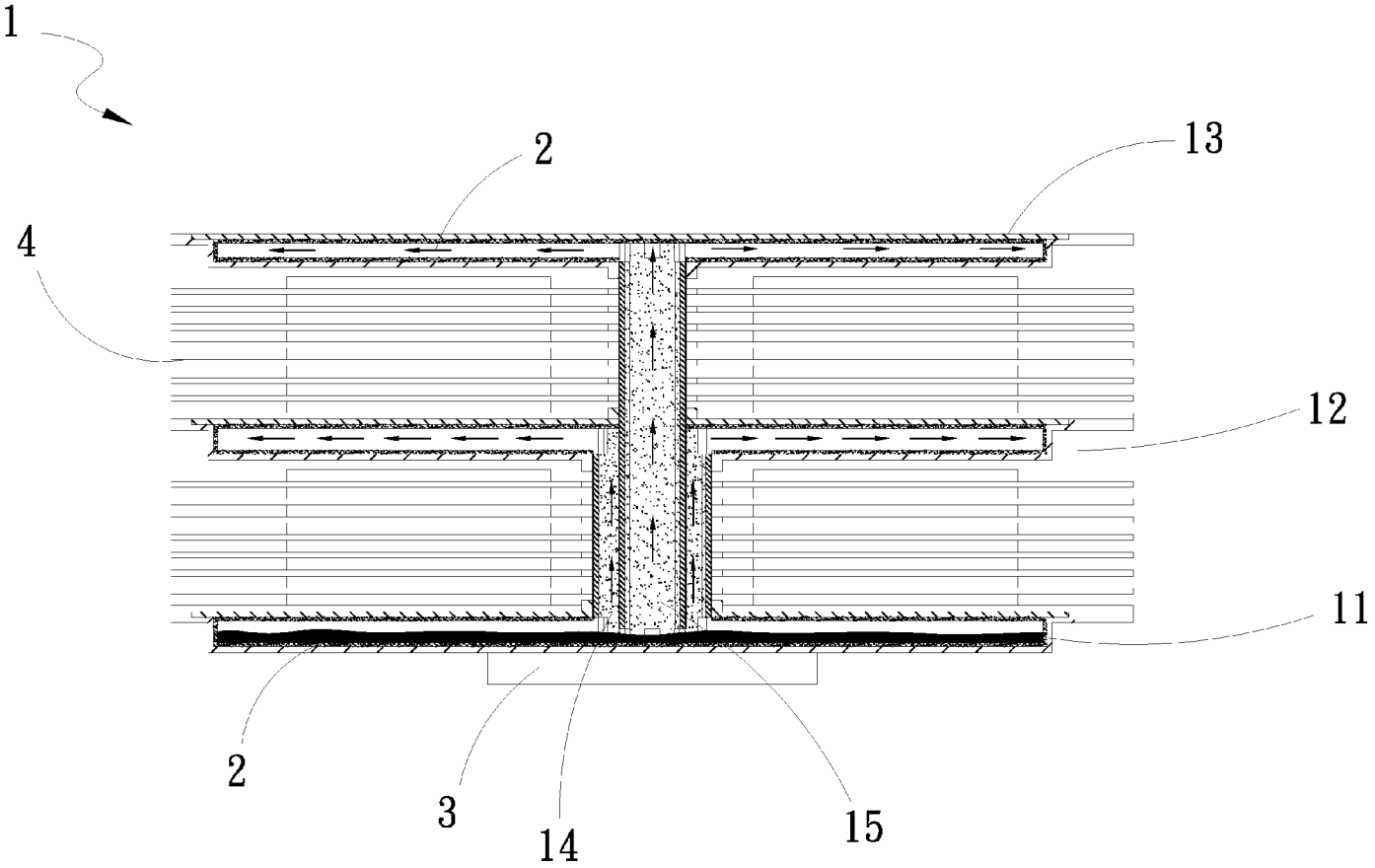
FIG. 4 is another sectional view of the first embodiment of the heat dissipation component of the present invention.

Please further refer to FIG. 4. At least one heat sink 4 is disposed between the first and second main bodies 11, 12 and the second and third main bodies 12, 13. The first plate body 111 of the first main body 11 is, but not limited to, in contact with a heat source 3 (such as a CPU, an MCU or a GPU). In practice, according to the internal arrangement of an electronic apparatus, the heat source 3 may alternatively contact the sixth plate body 132 of the third main body 13 (not shown). The heat sink 4 can be selectively disposed between the first and second main bodies 11, 12 or the second and third main bodies 12, 13 (not shown). Alternatively, two heat sinks 4 can be respectively disposed between the first and second main bodies 11, 12 and between the second and third main bodies 12, 13.

When the first main body 11 of the heat dissipation component 1 contacts the heat source 3, the liquid working fluid 2 in the first chamber 113 will absorb the heat and become vapor working fluid 2. Then, the vapor working fluid 2 will partially flow through the first perforation 1411 and the first flow way 143 into the second chamber 123. The vapor working fluid 2 will condense and convert into liquid working fluid 2 in the second chamber 123. Then, the liquid working fluid 2 will flow back into the first chamber 113 through the second and fourth capillary structures 124, 144 to continuously circulate. The other part of the vapor working fluid 2 will flow through the first perforation 1411 of the first tubular body 14 and the second flow way 153 into the third chamber 133. The vapor working fluid 2 will condense and convert into liquid working fluid 2 in the third chamber 133. Then, the liquid working fluid 2 will flow back into the first chamber 113 through the third and fifth capillary structures 134, 154 to continuously circulate. The heat sinks 4 disposed between the first and second main bodies 11, 12 and the second and third main bodies 12, 13 cooperatively dissipate the heat to complete the vapor-liquid circulation in the heat dissipation component 1. Therefore, the heat dissipation component 1 can achieve multiple heat dissipation effects to greatly enhance the heat exchange efficiency.

Moreover, two ends of the first and second tubular bodies 14, 15 respectively abut against the inner sides of the first, second and third main bodies 11, 12, 13 instead of the support structure in the conventional vapor chamber. This effectively saves cost and shortens the manufacturing time.

Figure 5:
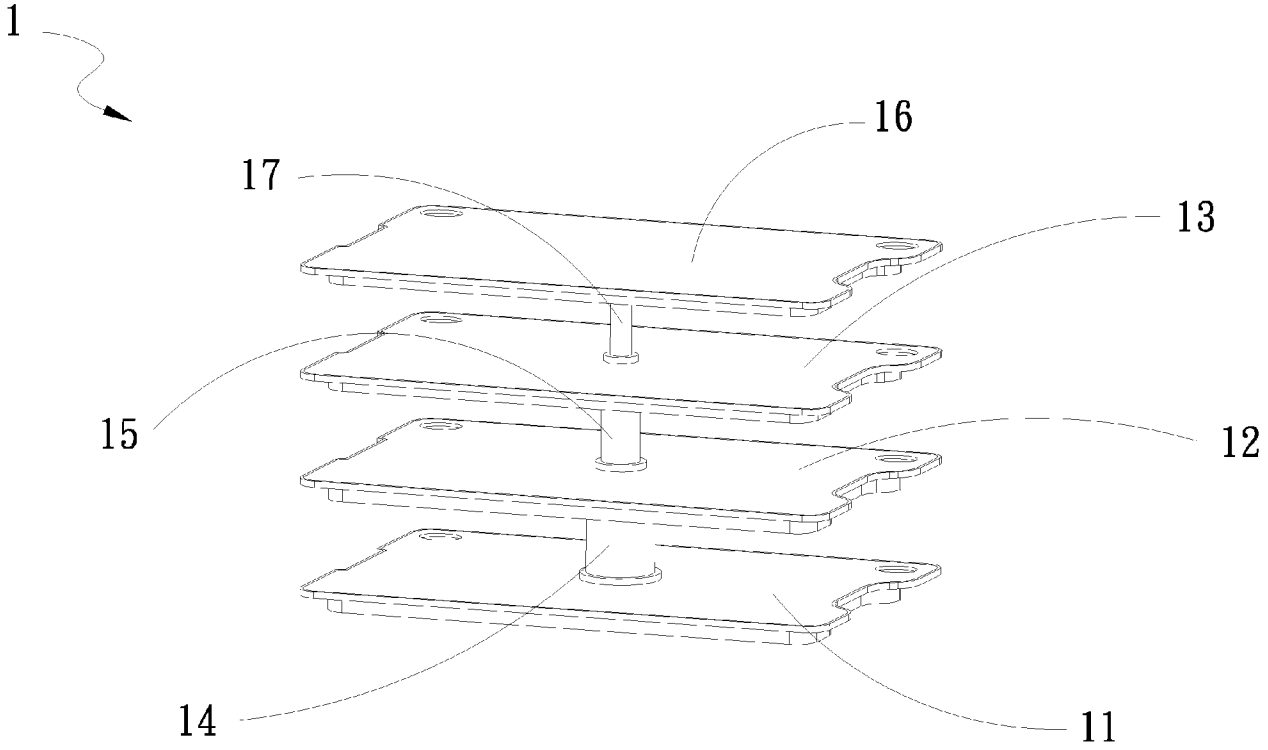
FIG. 5 is a perspective assembled view of a second embodiment of the heat dissipation component of the present invention.
Figure 6:
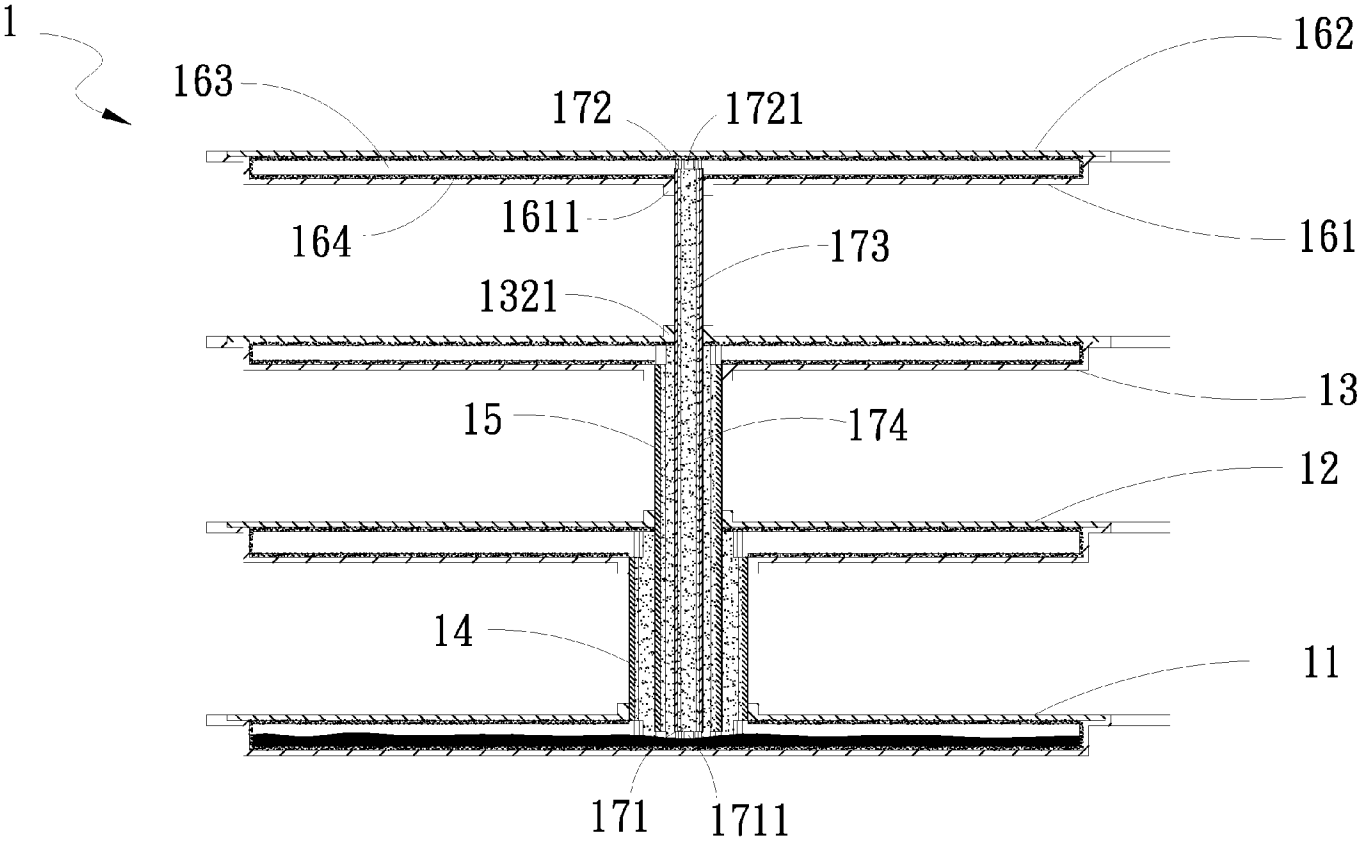
FIG. 6 is a sectional view of the second embodiment of the heat dissipation component of the present invention.
Figure 7:
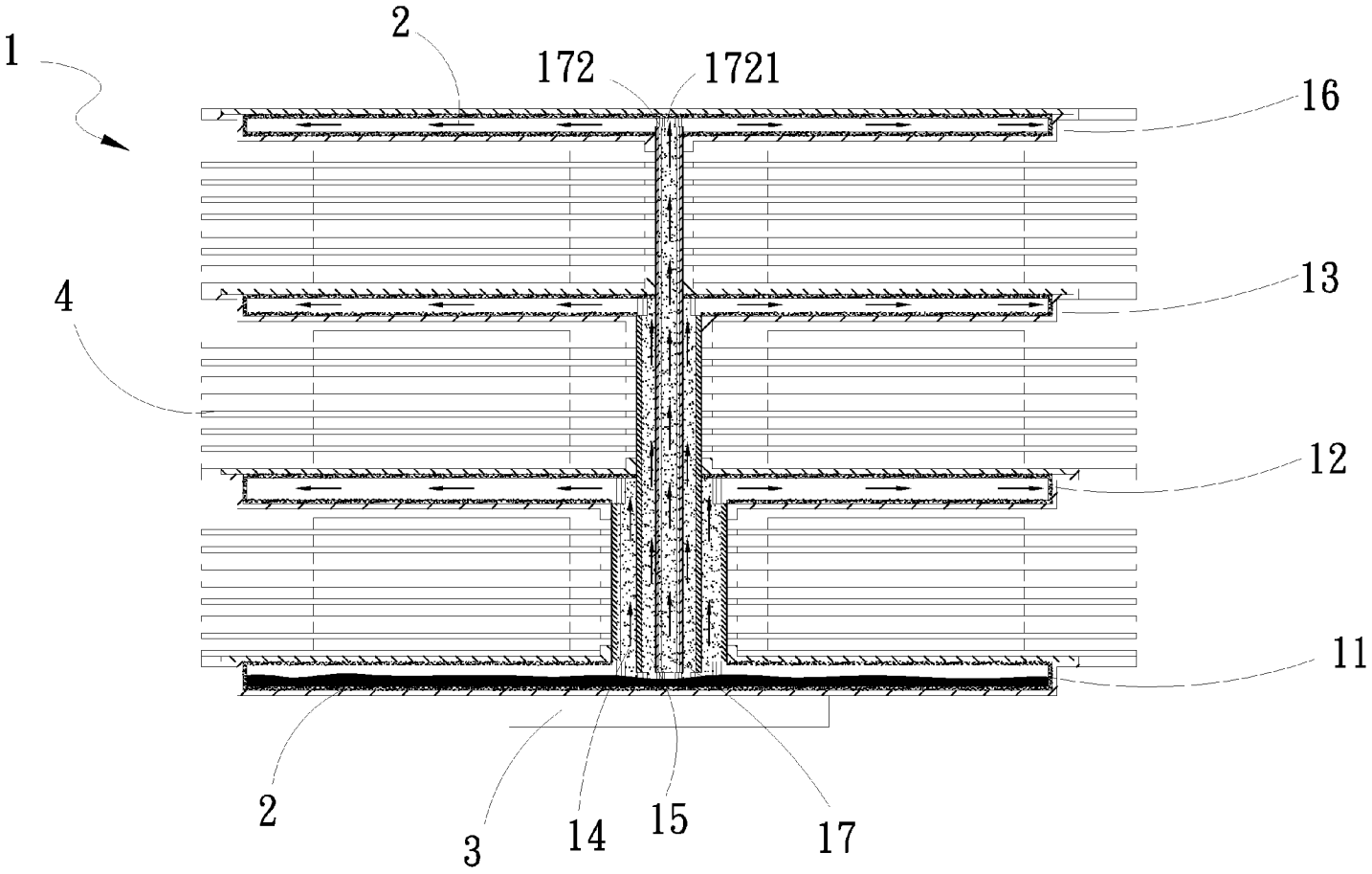
FIG. 7 is another sectional view of the second embodiment of the heat dissipation component of the present invention.

Please now refer to FIGS. 5, 6 and 7 and supplementally refer to FIGS. 1, 2 and 3. FIG. 5 is a perspective assembled view of a second embodiment of the heat dissipation component of the present invention. FIG. 6 is a sectional view of the second embodiment of the heat dissipation component of the present invention. FIG. 7 is another sectional view of the second embodiment of the heat dissipation component of the present invention. The second embodiment is partially identical to the first embodiment in component and relationship between the components and thus will not be repeatedly described. The second embodiment is mainly different from the first embodiment in that the sixth plate body 132 is further formed with a fifth connection section 1321 in alignment with the fourth connection section 1311. The heat dissipation component 1 further has a fourth main body 16 and a third tubular body 17. The fourth main body 16 has a seventh plate body 161 and an eighth plate body 162. The seventh and eighth plate bodies 161, 162 are correspondingly mated with each other to together define a fourth chamber 163. A sixth capillary structure 164 is disposed in the fourth chamber 163. The seventh plate body 161 is formed with a sixth connection section 1611.

The third tubular body 17 is passed through the second and third main bodies 12, 13 and in capillary contact with the first and fourth main bodies 11, 16. The third tubular body 17 is formed with an internal third flow way 173. A seventh capillary structure 174 is disposed on inner wall face of the third tubular body 17. The third tubular body 17 has a fifth end 171 and a sixth end 172. The fifth end 171 is passed through the first, second, third, fourth and fifth connection sections 1121, 1211, 1221, 1311, 1321 and the second flow way 153 and abuts against the inner side of the first plate body 111. The sixth end 172 is connected with the sixth connection section 1611 and abuts against the inner side of the eighth plate body 162. The seventh capillary structure 174 is in capillary contact with the first and sixth capillary structures 114, 164. The fifth end 171 is formed with at least one fifth perforation 1711 in communication with the first chamber 113. The sixth end 172 is formed with at least one sixth perforation 1721 in communication with the fourth chamber 163. Accordingly, the third flow way 173 communicates with the first and fourth chambers 113, 163 through the fifth and sixth perforations 1711, 1721.

The third tubular body 17 has a diameter smaller than that of the second tubular body 15. The diameter of the fifth and sixth connection sections 1321, 1611 is smaller than the diameter of the third and fourth connection sections 1221, 1311. A hub section is formed on each of the fifth and sixth connection sections 1321, 1611, whereby the fourth main body 16 and the third tubular body 17 can be tightly connected with the third main body 13.

Similarly, when the first main body 11 contacts the heat source 3, the liquid working fluid 2 in the first chamber 113 will absorb the heat and become vapor working fluid 2. Then, part of the working fluid 2 will circulate as in the first embodiment. The other part of the vapor working fluid 2 will flow through the first perforation 1411 of the first tubular body 14 and the third flow way 173 into the fourth chamber 163. The vapor working fluid 2 will condense and convert into liquid working fluid 2 in the fourth chamber 163. Then, the liquid working fluid 2 will flow back into the first chamber 113 through the sixth and seventh capillary structures 164, 174 to continuously circulate. Therefore, the vapor-liquid circulation is completed to achieve multiple heat dissipation effects.

In other words, the structural design of the present invention is not limited to the above first and second embodiments. According to the requirements of a user, the numbers of the main bodies and the tubular bodies can be adjusted (increased or decreased) to achieve best use effect.

Figure 8:
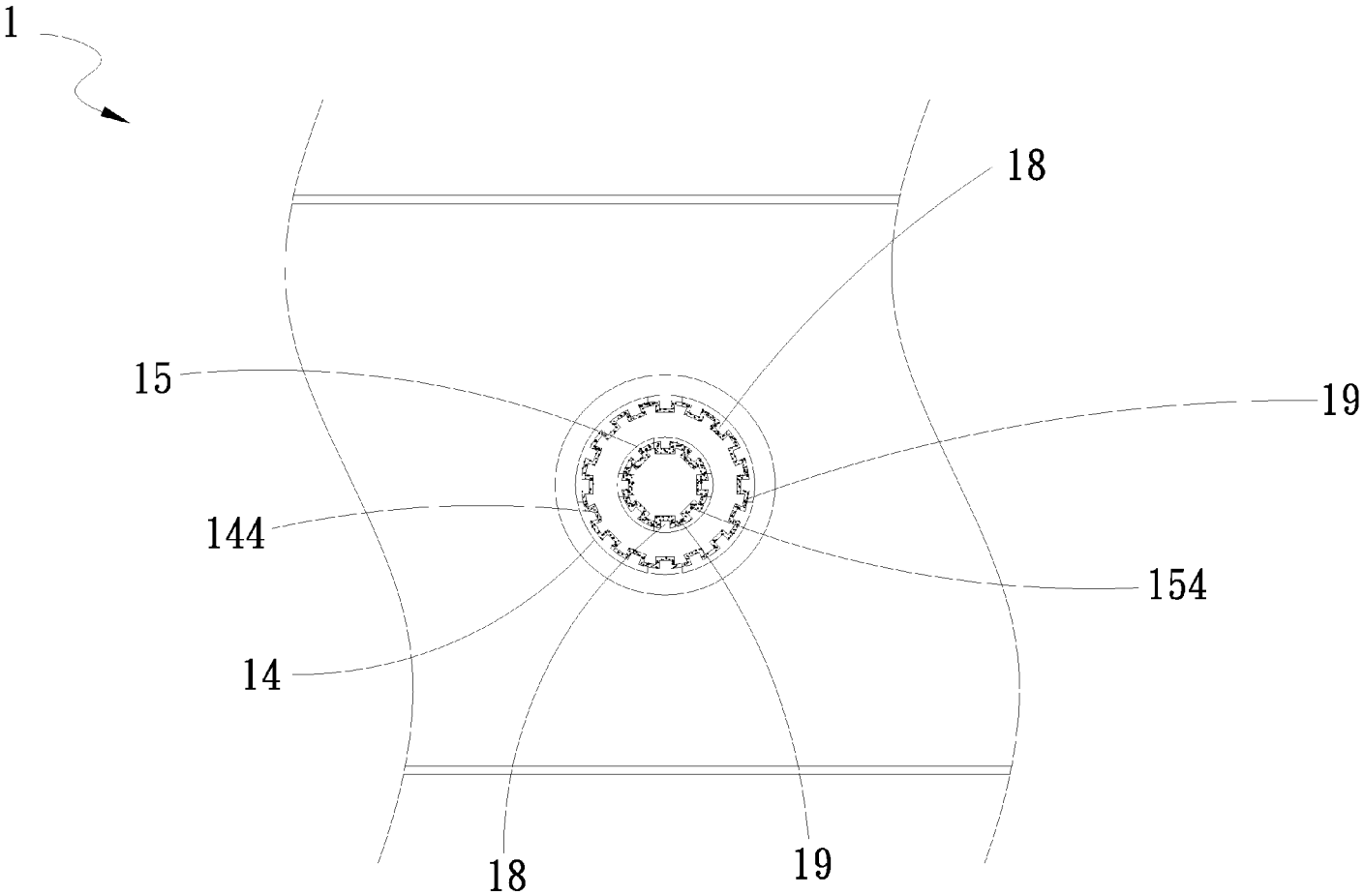
FIG. 8 is a top view of a third embodiment of the heat dissipation component of the present invention.

Please now refer to FIG. 8, which is a top view of a third embodiment of the heat dissipation component of the present invention. The third embodiment is partially identical to the first embodiment in component and relationship between the components and thus will not be repeatedly described. The third embodiment is mainly different from the first embodiment in that multiple ribs 18 and multiple channels 19 are formed on inner wall faces of the first and second tubular bodies 14, 15. The ribs 18 and channels 19 are alternately arranged or not alternately arranged. The fourth and fifth capillary structures 144, 154 are respectively disposed on the ribs 18 and the channels 19 of the first and second tubular bodies 14, 15. According to such arrangement, the areas of the fourth and fifth capillary structures 144, 154 on the inner wall faces of the first and second tubular bodies 14, 15 can be increased. In this case, the backflow effect of the liquid working fluid in the tubular bodies can be enhanced. Similarly, the arrangement of the ribs 18 and the channels 19 is not limited to the above embodiment. The ribs 18 and the channels 19 can be freely disposed on the necessary tubular bodies according to the requirements of a user.

Figure 9:
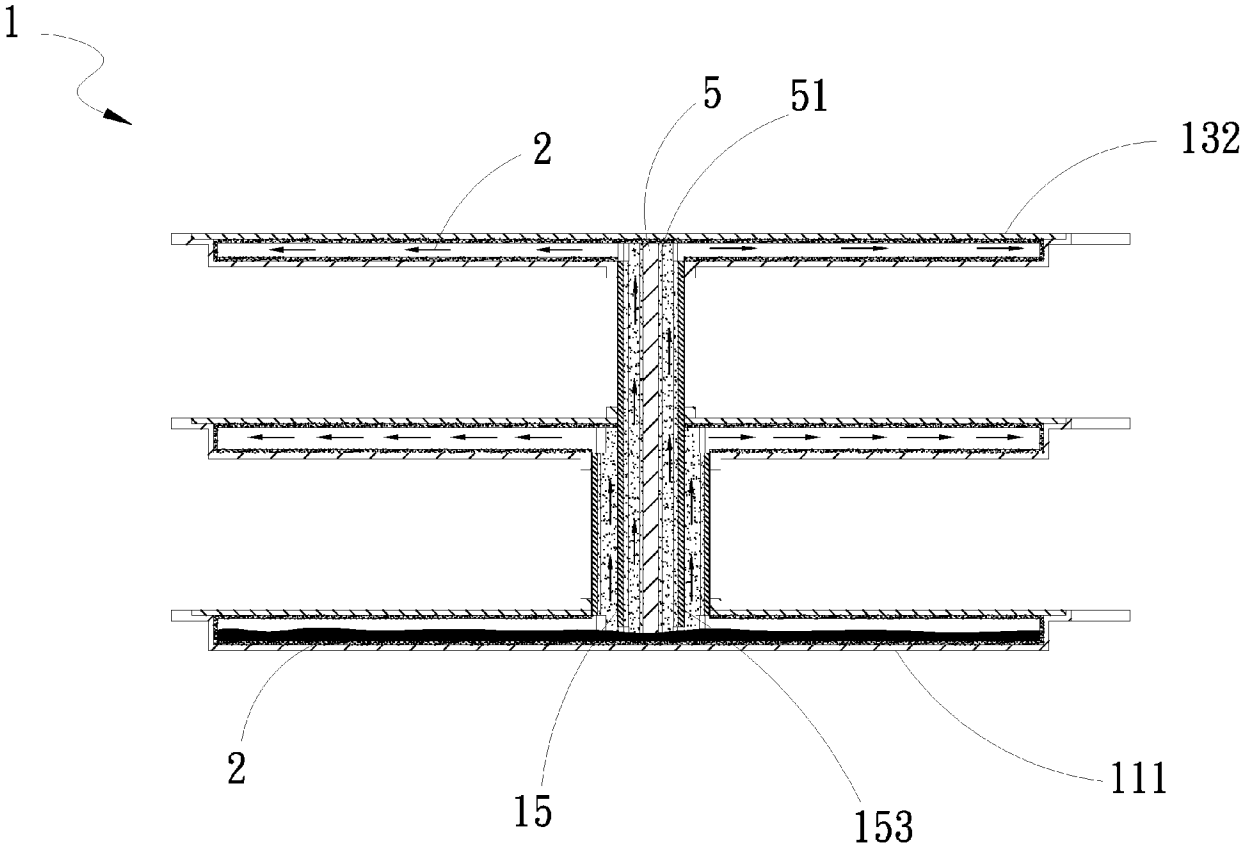
FIG. 9 is a sectional view of a fourth embodiment of the heat dissipation component of the present invention.

Please now refer to FIG. 9, which is a sectional view of a fourth embodiment of the heat dissipation component of the present invention. The fourth embodiment is partially identical to the first embodiment in component and relationship between the components and thus will not be repeatedly described. The fourth embodiment is mainly different from the first embodiment in that a support column 5 is further disposed in the second flow way 153 of the second tubular body 15. Two ends of the support column 5 respectively abut against the inner sides of the first plate body 111 and the sixth plate body 132. An eighth capillary structure 51 is disposed on outer surface of the support column 5. The eighth capillary structure 51 is selected from a group consisting of mesh body, fiber body, sintered powder body, combination of mesh body and sintered powder and micro-groove body. In this embodiment, the support column 5 serves to greatly enhance the backflow rate of the liquid working fluid 2 in the heat dissipation component 1. Also, the support column 5 serves to provide supporting effect.

In conclusion, in comparison with the conventional vapor chamber, the present invention has the following advantages:

1. The present invention can provide multiple heat dissipation effects.
2. The present invention can greatly enhance the heat exchange efficiency.
3. The cost for the support structure of the conventional vapor chamber is saved and the manufacturing time is shortened.

The present invention has been described with the above embodiments thereof and it is understood that many changes and modifications in the above embodiments can be carried out without departing from the scope and the spirit of the invention that is intended to be limited only by the appended claims.

What is claimed is:

1. A heat dissipation component comprising:

a first main body having an enclosed first chamber;

a second main body having an enclosed second chamber;

a first tubular body having a first end, a second end and a first flow way, the first and second ends being respectively connected with the first and second main bodies, the first flow way communicating with the enclosed first and second chambers;

a third main body having an enclosed third chamber;

a second tubular body having a third end, a fourth end and a second flow way, the second tubular body being passed through the second main body and the first flow way of the first tubular body, the third and fourth ends being respectively connected with the first and third main bodies, the second flow way communicating with the enclosed first and third chambers; and a working fluid filled in the enclosed first, second and third chambers.

2. The heat dissipation component as claimed in claim 1, wherein the first main body has a first plate body and a second plate body, the first and second plate bodies being correspondingly mated with each other to together define the first chamber, the second plate body being formed with a first connection section, the second main body having a third plate body and a fourth plate body, the third and fourth plate bodies being correspondingly mated with each other to together define the second chamber, the third plate body being formed with a second connection section, the first end being correspondingly connected with the first connection section and abutting against inner side of the first plate body, the second end being correspondingly connected with the second connection section and abutting against inner side of the fourth plate body, the first end being formed with at least one first perforation in communication with the first chamber, the second end being formed with at least one second perforation in communication with the second chamber, whereby the first flow way communicates with the first and second chambers through the first and second perforations.

3. The heat dissipation component as claimed in claim 2, wherein the fourth plate body is further formed with a third connection section in alignment with the second connection section, the third main body having a fifth plate body and a sixth plate body, the fifth and sixth plate bodies being correspondingly mated with each other to together define the third chamber, the fifth plate body being formed with a fourth connection section, the third end being passed through the first, second and third connection sections and the first flow way and abutting against the inner side of the first plate body, the fourth end being correspondingly connected with the fourth connection section and abutting against inner side of the sixth plate body, the third end of the second tubular body being formed with at least one third perforation in communication with the first chamber, the fourth end of the second tubular body being formed with at least one fourth perforation in communication with the third chamber, whereby the second flow way communicates with the first and third chambers through the third and fourth perforations.

4. The heat dissipation component as claimed in claim 3, wherein a first capillary structure is disposed in the first chamber, a second capillary structure is disposed in the second chamber and a third capillary structure is disposed in the third chamber.

5. The heat dissipation component as claimed in claim 4, wherein a fourth capillary structure is disposed on an inner wall face of the first tubular body and a fifth capillary structure is disposed on an inner wall face of the second tubular body.

6. The heat dissipation component as claimed in claim 5, wherein the fourth capillary structure is in capillary contact with the first and second capillary structures.

7. The heat dissipation component as claimed in claim 5, wherein the fifth capillary structure is in capillary contact with the first and third capillary structures.

8. The heat dissipation component as claimed in claim 1, wherein the second tubular body has a diameter smaller than a diameter of the first tubular body.

9. The heat dissipation component as claimed in claim 3, wherein the sixth plate body is further formed with a fifth connection section in alignment with the fourth connection section, the heat dissipation component further comprising a fourth main body, the fourth main body having a seventh plate body and an eighth plate body, the seventh and eighth plate bodies being correspondingly mated with each other to together define a fourth chamber, the seventh plate body being formed with a sixth connection section, a third tubular body being passed through the second and third main bodies and connected with the first and fourth main bodies, the third tubular body being formed with an internal third flow way, the third tubular body having a fifth end and a sixth end, the fifth end being passed through the first, second, third, fourth and fifth connection sections and the second flow way and abutting against the inner side of the first plate body, the sixth end being correspondingly connected with the sixth connection section and abutting against an inner side of the eighth plate body, the fifth end being formed with at least one fifth perforation in communication with the first chamber, the sixth end being formed with at least one sixth perforation in communication with the fourth chamber, whereby the third flow way communicates with the first and fourth chambers.

10. The heat dissipation component as claimed in claim 9, wherein a sixth capillary structure is disposed in the fourth chamber and a seventh capillary structure is disposed on an inner wall face of the third tubular body, the seventh capillary structure being in capillary contact with the first and sixth capillary structures.

11. The heat dissipation component as claimed in claim 10, wherein the third tubular body has a diameter smaller than a diameter of the second tubular body.

12. The heat dissipation component as claimed in claim 5, wherein multiple ribs and multiple channels are formed on inner wall faces of the first and second tubular bodies, the ribs and channels being alternately arranged or not alternately arranged, the fourth and fifth capillary structures being respectively disposed on the ribs and the channels of the first and second tubular bodies.

13. The heat dissipation component as claimed in claim 3, wherein a support column is further disposed in the second flow way, two ends of the support column respectively abutting against the inner sides of the first plate body and the sixth plate body, an eighth capillary structure being disposed on outer surface of the support column.

* * * * *